United States Patent [19]

Steinberg

[11] Patent Number: 4,460,000

[45] Date of Patent: Jul. 17, 1984

[54] VACUUM AND GAS EXPANSION OF TOBACCO

[75] Inventor: Ira H. Steinberg, East Brunswick, N.J.

[73] Assignee: The BOC Group, Inc., Montvale, N.J.

[21] Appl. No.: 387,912

[22] Filed: Jun. 14, 1982

[51] Int. Cl.[3] ..... A24B 3/18

[52] U.S. Cl. ..... 131/296; 131/291

[58] Field of Search ..... 131/291, 292, 293, 294, 131/295, 296, 900

[56] References Cited

U.S. PATENT DOCUMENTS

| | | | |
|---|---|---|---|
| 3,753,440 | 8/1973 | Ashburn | 131/296 |
| 3,982,550 | 9/1976 | de la Burde et al. | 131/293 |
| 4,235,250 | 11/1980 | Utsch | 131/900 |
| 4,258,729 | 3/1981 | de la Burde et al. | 131/291 |

FOREIGN PATENT DOCUMENTS

| | | | |
|---|---|---|---|
| 1484536 | 9/1977 | United Kingdom | 131/291 |

*Primary Examiner*—V. Millin
*Assistant Examiner*—G. Beaucage
*Attorney, Agent, or Firm*—David L. Rae; Larry R. Cassett

[57] ABSTRACT

Tobacco is expanded by cooling the same to a temperature of about 30° F. or less and subjecting such cooled tobacco to a subatmospheric pressure in a vessel. $CO_2$ gas is then introduced into the vessel and contacts the cooled tobacco to impregnate the tobacco with $CO_2$ gas as pressure in the vessel is brought to substantially atmospheric pressure. Subsequently, the cooled $CO_2$ impregnated tobacco is subjected to conditions whereby the $CO_2$ in the tobacco is removed and the tobacco is expanded. Typically, the $CO_2$ impregnated tobacco is introduced into an expansion tower wherein it is heated to increase the volume of the $CO_2$ and to expand the tobacco in size.

10 Claims, No Drawings

VACUUM AND GAS EXPANSION OF TOBACCO

BACKGROUND OF THE INVENTION

The present invention relates to methods for expanding tobacco and more particularly to methods wherein a gaseous agent is utilized to impregnate the tobacco under relatively low pressure conditions prior to expansion.

In the course of cutting, curing and otherwise preparing tobacco for use in the manufacture of smoking products such as cigarettes, the density of tobacco is increased relative to the density of tobacco in a natural condition. Thus, the processed tobacco utilized in the manufacture of cigarettes is frequently of a density greater than is necessary for producing acceptable smoking products. Various techniques, as will be subsequently discussed, for reducing the density of such tobacco have been proposed in order to reduce the weight of tobacco per cigarette unit. However, there are certain prerequisites that processes for expanding tobacco, i.e. increasing the filling capacity thereof, must meet. Expansion processes must not have any significant deleterious effect on the flavor, aroma, and other taste characteristics or visual appearance of cigarettes utilizing such tobacco. Furthermore, these processes must not cause undue breakage or physical deterioration of tobacco particles as fines or dust are not suitable for direct use in the manufacture of cigarettes or the like.

Currently, there is a demand for expanded tobacco in low yield cigarettes and consequently, there is a need for effective techniques for expanding tobacco.

As mentioned above, numerous prior art techniques for expanding tobacco have been proposed and these techniques essentially utilize a gaseous or liquid expansion agent for initially impregnating the tobacco therewith such that upon subsequent removal of the agent from the tobacco, the latter is expanded. One process for expanding tobacco with the use of a vapor impregnating agent is illustrated in U.S. Pat. No. 3,144,871 which describes a process wherein tobacco is contacted with the vapor phase of an organic solvent such as hexane or toluene under temperatures of approximately 75° C. The vapor condenses on the tobacco to impregnate the same after which the impregnated tobacco is dried in air to cause expansion thereof. This process has the disadvantages of utilizing hydrocarbon based materials such as toluene or hexane and results in relatively low levels of expansion as the filling capacity of treated tobacco is increased by amounts of only up to approximately 15%.

Other techniques for expanding tobacco have utilized subatmospheric or vacuum conditions as, for example, is illustrated in U.S. Pat. No. 3,409,022. In this process, tobacco stems are puffed by subjecting stems to vacuum pressures of approximately 10–30 mmHg and exposing such stems to radiant energy. Typically, the stems being expanded are subjected to radiant heat in a furnace having a temperature of approximately 350° C. and the combined effect of subatmospheric pressures and exposure to radiant energy has been found to increase the filling capacity of the stems. It is also known to subject tobacco to be expanded to a vacuum pressure to remove occluded air and then contact such tobacco with an organic compound having a boiling point of between −10 to 80° C. at atmospheric pressure. This process is described in U.S. Pat. No. 3,753,440 and in accordance with the teachings of this reference, vapor is condensed in the tobacco prior to treating the impregnated tobacco with a heated gas stream whereby moisture and the condensed vapor are removed from the tobacco in a manner so as to expand or increase the filling capacity of the tobacco. Commonly, the organic compounds utilized in this process are halogenated hydrocarbons such as triclorofluoromethane and these compounds require careful handling due to the inherent toxicity thereof and must be completely removed from the expanded tobacco. In addition, it is common to recover the vapors and liquid phase of such compounds for future use and such recovery equipment increases the capital cost of the apparatus for practicing this process.

It is also known to expand tobacco by soaking tobacco in water prior to freezing the water and then applying a vacuum pressure to the frozen mass of water and tobacco to cause sublimation of water ice and expansion of the tobacco. Such a process is illustrated in U.S. Pat. No. 3,785,385 and although tobacco can be expanded by means of this process, the same is relatively expensive in that a vacuum must be maintained notwithstanding the essentially continuous sublimation of water ice into the vacuum. Thus, the operating costs in the form of electrical power required to drive vacuum equipment is extremely high and these processes have not found widespread commercial acceptance. A similar process is described in U.S. Pat. No. 3,982,550. In U.S. Pat. No. 2,653,093 a process for expanding organic materials including tobacco is proposed wherein air is removed from the product to be puffed which is then exposed to steam at high pressure and temperature to establish a desired moisture content therein. This pressure is reduced into a vacuum zone which is effective to cause a cold setting of the puffed tobacco. It is believed that this latter process would require the establishment and maintenance of a substantial vacuum zone which as indicated above results in high operating costs.

In addition to the foregoing prior art processes, it has been proposed to utilize $CO_2$ gas as an impregnating agent as described in U.S. Pat. Nos. 4,235,250 and 4,258,729. In these latter processes, $CO_2$ gas at a pressure of 250 psig or greater is utilized to impregnate tobacco after which the pressure is released and the $CO_2$ treated tobacco is rapidly heated to remove $CO_2$ therefrom and thereby expand the tobacco. These processes require relatively expensive, high pressure equipment and typically utilize $CO_2$ in such volumes that it is economically preferable to recover excess $CO_2$ gas and recycle the same for further use. The latter steps also require additional recovery equipment which increases the cost of the total apparatus for carrying out such processes. In U.S. Pat. No. 4,250,898, a process for expanding tobacco is described wherein $CO_2$ gas is utilized to impregnate tobacco under pressures of at least 50 psig while the temperature of the $CO_2$ and tobacco is reduced to a temperature close to the saturation temperature of $CO_2$ but no lower than −23° C. and to a point above which any condensation of carbon dioxide occurs. The $CO_2$ treated tobacco is then rapidly cooled so that $CO_2$ condenses as a liquid onto (or forms as a solid in) the tobacco and finally solidifies upon release of such pressure. The impregnated tobacco is then passed through an expansion tower to remove $CO_2$ therefrom and expand the impregnated tobacco. This process, however, also requires the use of relatively high pressure equipment and additional equipment for recovering excess $CO_2$ from an impregnating vessel.

Finally, processes for expanding tobacco wherein liquid $CO_2$ is utilized as the expansion agent have been found to be commercially acceptable. However, as such processes are conducted at relatively high pressures, the cost of equipment for impregnating tobacco and for recovering excess liquid and gaseous $CO_2$ is significant and thus adds to the overall cost of so expanding tobacco. These processes are described in U.K. Specifications Nos. 1,444,309 and 1,484,536.

Consequently, it will be understood that there is a clear need for processes for expanding tobacco which are relatively inexpensive and which utilize non-toxic expansion agents and do not require high pressure conditions or equipment or undue operating costs. In addition, desired tobacco expansion processes must not result in excessive breakage or comminution of tobacco or significant, deleterious changes in the flavor, aroma or appearance thereof while yet enabling economically justifiable levels of permanent expansion to be obtained.

OBJECTS OF THE INVENTION

It is an object of the present invention to provide improved methods for expanding tobacco.

It is another object of the present invention to expand tobacco under relatively low pressure conditions and to utilize reduced quantities of impregnating agents.

It is yet another object of the present invention to expand tobacco in a safe and efficient manner without excessive physical or chemical deterioration of the expanded tobacco.

It is a further object of the present invention to provide methods for expanding tobacco which may be practiced with equipment of relatively low capital cost.

It is yet another object of the present invention to provide methods for expanding tobacco requiring only economical utilization of expansion agents and which avert the necessity to recover excess quantities thereof following the impregnation of tobacco by the expansion agent.

Other objects of the present invention will become apparent from the following description of exemplary embodiments thereof which follows and the novel features will be particularly pointed out in conjunction with the claims appended hereto.

SUMMARY

In accordance with the present invention, tobacco is expanded by a process comprised of the steps of cooling tobacco to a temperature of approximately 30° F. or less, subjecting such cooled tobacco to a subatmospheric pressure in a vessel, introducing $CO_2$ gas into such vessel so that the cooled tobacco is impregnated therewith and then subjecting the cooled $CO_2$ impregnated tobacco to conditions such that the impregnated $CO_2$ is removed from the tobacco whereby the tobacco is expanded in size. In accordance with the invention, tobacco to be expanded is preferably cooled to a temperature of 0° F. or less and may be cooled either before or while it is in a vessel and cooling may be effected by direct or indirect heat exchange with a refrigerant such as solid or cold gaseous $CO_2$ or by the use of conventional mechanical refrigeration. Dry, inert gas may be introduced into the vessel to avoid condensation of moisture from ambient air onto the tobacco during cooling as such condensation may noticeably alter the moisture content of the tobacco.

The cooled tobacco is subjected to a subatmospheric, i.e. vacuum, pressure typically by applying a vacuum to the closed vessel containing the tobacco. A vacuum pressure of less than about 25 mm Hg and preferably about 3 mm Hg or lower is established in the vessel and this will result in the removal of ambient air from interstitial spaces between individual tobacco fibers. A desired vacuum pressure is maintained in the vessel long enough to assure that a stable subatmospheric pressure condition has been established at which point $CO_2$ gas, which may be cooled to increase the density thereof, is introduced into the vessel to "break" the vacuum and cause the pressure therein to rise to substantially atmospheric pressure. $CO_2$ gas will enter the interstitial spaces between and will directly contact the tobacco fibers. Typically an amount of $CO_2$ necessary to increase the weight of the tobacco by about 0.5–3.0% will be added to the tobacco so impregnated.

The cooled, $CO_2$ impregnated tobacco is then preferably removed from the impregnating vessel and is subjected to conditions such that the impregnated $CO_2$ is removed from the tobacco whereby the latter is expanded. The cooled, impregnated tobacco may be passed through an expansion tower by means of a stream of heated gases (typically at a temperature of between 300–700° F.) which is an effective technique to increase the volume of the $CO_2$ in the tobacco which results in $CO_2$ escaping from the tobacco and expansion of the tobacco in size by amounts of up to about 100% or more. The expanded tobacco will retain its increased size, i.e. volume, indefinitely and may be utilized in conventional processes for manufacturing cigarettes or other smoking products. Thus, tobacco expanded in accordance with the process of the present invention may be subjected to handling operations and compaction forces commonly utilized by the tobacco industry without significant breakage of loss of filling power of the expanded tobacco.

DESCRIPTION OF PREFERRED EMBODIMENT

Before describing the process according to the invention in detail, it is believed helpful to define certain terms. For example, "tobacco" shall include flue-cured, Burley, Turkish, etc. any blend or blends or stems, cut filler or even reconstituted tobacco. Although reference is made herein to "cigarettes", it will be understood that tobacco expanded by the process according to the invention may be utilized in other smoking products as well as cigarettes.

Prior to subjecting tobacco to an expansion process, it is common to adjust the moisture thereof to a desired level by spraying or otherwise contacting the tobacco with water or water vapor. For example, the moisture level of tobacco will be adjusted to a desired level to improve the expansion during an expansion process. Typically, tobacco will contain about 10–30% moisture under ambient conditions prior to commencement of an expansion process.

The tobacco to be expanded by the process according to the invention is cooled to a temperature below about 30° F. and is preferably cooled to temperatures of about 0 to −110° F. Cooling of tobacco may be carried out by any convenient means such as directly contacting the tobacco with a refrigerant such as solid $CO_2$ (having a temperature of −110° F. at atmospheric pressure), placing the tobacco in direct or indirect heat exchange with solid $CO_2$ or other refrigerant or by passing cold air into direct contact with the tobacco as occurs in the cooling of materials by conventional mechanical refrigeration. Alternatively, tobacco may be passed on a conveyor device through a zone of low temperature so that the tobacco is cooled to a desired temperature in a manner similar to the freezing or chilling of food products in "tunnels" or similar devices. It will be understood that the particular type of cooling system, refrigerant or heat exchange mechanism utilized is not critical to the present invention as any suitable technique for cooling tobacco may be employed.

Cooling of tobacco may be effected under an atmosphere of relatively dry inert gas such as $CO_2$ or $N_2$ such that condensation of moisture in ambient air and contact between this moisture and the tobacco is averted. As mentioned previously, tobacco to be expanded is usually moistened to a desired moisture level and condensation of moisture from ambient air would tend to increase the moisture of tobacco from a known controlled level depending on the current atmospheric humidity.

Following cooling, the tobacco is subjected to subatmospheric or vacuum pressure conditions in a suitable vessel or chamber. It will be understood, however, that cooling of tobacco may occur simultaneously with subjection of tobacco to vacuum pressures. Preferably, a relatively low vacuum pressure of about 3.0 mmHg is drawn on the cooled tobacco although vacuum pressures in the range of about 25 mm Hg or lower are acceptable. The applied vacuum pressure is effective to remove ambient air from the vessel or chamber and to withdraw ambient air from the interstitial spaces between individual tobacco fibers. The vacuum pressure is maintained for a period of time of sufficient duration to assure that the gaseous contents of the vessel have been essentially removed therefrom and that a stable vacuum pressure is established therein. Typically, a vacuum pressure is applied to the vessel or chamber for about 1.0–30 minutes.

Following the establishment of vacuum conditions as mentioned above, the vacuum is "broken" by introducing, i.e. backfilling, the vessel with $CO_2$ gas until substantially atmospheric pressure is reached. The introduced $CO_2$ gas is drawn into the interstitial spaces between tobacco fibers as mentioned above and is thereby effective to at least partially impregnate the tobacco with $CO_2$ gas. Upon introduction of $CO_2$ into the vessel, the vessel interior will be at a slightly higher pressure than will be existent in the interstitial spaces between tobacco fibers and consequently, $CO_2$ gas will flow from the location of higher pressure to the location of lower pressure thereby achieving at least partial impregnation of the tobacco in the vessel.

Although the scope of the invention is not to be limited by the following, it is believed that as $CO_2$ gas contacts the tobacco, some $CO_2$ gas is dissolved in the liquid organic components of the tobacco. As these components are aqueous in nature and as $CO_2$ is somewhat soluble therein, it is believed that a portion of the $CO_2$ gas contacting the tobacco may also be chemically combined or bound-up with such components and thus, additional $CO_2$ is retained by the tobacco during the impregnation thereof, i.e. introduction of $CO_2$ gas into the tobacco containing vessel. Thus, $CO_2$ is believed to be both physically and chemically retained by the tobacco. It is also believed that the solubility of $CO_2$ in tobacco components is inversely related to the temperature of the tobacco and that by cooling tobacco to temperatures mentioned above, $CO_2$ gas is considerably more soluble in such components than if contact between $CO_2$ and tobacco occurred at ambient temperature (i.e. 70° F.) and under the vacuum pressures described above. In addition, the density of $CO_2$ gas is greater at lower temperatures and by backfilling the vacuum chamber with cold $CO_2$ gas, a greater weight of $CO_2$ will be physically retained by the tobacco. The $CO_2$ gas is preferably chilled to a temperature below ambient and may be introduced into the vacuum chamber at about −40° F. or so. Thus, by establishing and maintaining the foregoing low temperatures the amount (weight) of $CO_2$ that can be impregnated into tobacco is increased and consequently a greater degree of expansion will be attainable. Preferably, an amount of $CO_2$ will be added to the tobacco such that the weight of tobacco will be increased by about 0.5–3.0% which in turn will enable the tobacco to be permanently expanded by up to about 50–100% or more.

It will be appreciated that impregnation of tobacco as described above will not require high pressure equipment which, for example is required to practice processes described in U.S. Pat. No. 4,258,729 and U.K. Specification Nos. 1,444,309 and 1,484,536, the latter being assigned to the assignee of the present invention. Consequently, the cost of equipment required for practice of the process according to the invention is less than with other prior art processes for expanding tobacco with carbon dioxide. Furthermore, as tobacco is impregnated with $CO_2$ gas under subatmospheric pressure in the process according to the invention, considerably less $CO_2$ is required in order to impregnate and expand each unit weight of tobacco than is required in the prior art processes mentioned just above. In fact, equipment for recovering excess $CO_2$ gas from the impregnating vessel (which gas is not retained by the tobacco therein) is not required as relatively little $CO_2$ gas is vented to atmosphere in comparison to excess amounts of $CO_2$ developed by prior art tobacco expansion processes. By averting the need for such recovery equipment, the overall cost to expand tobacco by the process according to the invention is reduced.

Returning now to the process according to the invention, the pressure in the impregnating vessel is brought to substantially atmospheric pressure. The vessel is opened to enable removal of $CO_2$ impregnated tobacco. Typically, the $CO_2$ impregnated tobacco is transferred from the impregnating vessel to an expansion tower or the like in which a temperature of about 300°–700° F. is established. Upon such heating, the $CO_2$ gas trapped in interstitial spaces between tobacco fibers is expanded and as this gas escapes from these spaces, the fibers are plastically deformed and the tobacco is thereby expanded. It is believed that as the $CO_2$ impregnated tobacco is so heated, $CO_2$ dissolved in tobacco components is driven therefrom and this $CO_2$ gas also expands in volume which contributes to the puffing or expansion of the tobacco.

The particular conditions existing in the expansion tower or other device for expanding tobacco will vary depending on the flow rate of heated gas and the rate at which impregnated tobacco is being supplied thereto. The residence time of tobacco in the tower, which is typically on the order of less than 1.0 second to about 20 seconds and the temperature in the tower will be selected so that maximum expansion is obtained without scorching, burning or changing the taste characteristics of the tobacco being expanded. The atmosphere of the expansion tower will typically be comprised of substances such as air, $CO_2$ and/or steam which exhibit high heat transfer characteristics for better heat transfer to the tobacco.

The stream of heated gases, which includes $CO_2$ removed, i.e. evolved, from the tobacco during expansion and the tobacco itself are supplied to a solid-vapor separating device, such as a cyclone separator or tangential classifier wherein these materials are separated from one another.

Experiments have been conducted in which processes according to the invention were utilized to expand tobacco. In these experiments tobacco samples, each of a predetermined weight (and volume) were placed in a chamber wherein humidity was controlled to establish a moisture level of approximately 11% in the tobacco. Samples of this tobacco which varied between 15 and 30 g were placed in an impregnator device comprised of a conduit of about 4" in diameter and about 9" in length. The conduit was provided with a bottom and top to form a vessel which was cooled to several different temperatures as indicated in the examples below by placing the impregnating device or vessel in direct heat exchange relation with solid $CO_2$. Different vacuum pressures were established and maintained for different periods in the impregnator device and in each experiment cooled $CO_2$ gas was admitted therein until atmospheric pressure was reached. At this point, the impregnator device was opened and $CO_2$ impregnated tobacco was removed and placed in a basket. The latter was fitted into a tower of 4" internal diameter which was heated by blowing heated air upwardly through the tower.

In order to calculate the extent of expansion of tobacco in accordance with the invention, the volume of a control sample of 10g of unexpanded tobacco was 38 cc and was measured at a moisture content of about 11%. The volume of expanded tobacco was determined by a cylinder volume test and each such volume was then corrected to a moisture level of 11%. In each test, the tobacco to be measured was placed in a cylinder and a cylindrical weight of approximately 4 lbs was placed in the cylinder on the tobacco. The extent to which the cylindrical weight depressed the tobacco gave an indication of the volume of the tobacco in the cylinder.

EXPERIMENT 1

A sample of tobacco was cooled to −40° F. and was subjected to a vacuum pressure of 2 mm Hg for a period of 10 minutes. $CO_2$ gas at a temperature of −40° F. was then admitted into the impregnator device for a period of 10 minutes and atmospheric pressure was established in the device. The tobacco impregnated with $CO_2$ was subjected to a stream of air heated to 530° F. for 14 seconds to expand the same. The sample of expanded tobacco exhibited a corrected cylinder volume of 65.7 cc/10 grams which corresponded to an expansion of the control sample of 77%.

EXPERIMENT 2

A tobacco sample was cooled to a temperature of −40° F. and was subjected to a vacuum pressure of 2 mm Hg for a period of 30 min. $CO_2$ gas at −40° F. was admitted into the impregnator device and retained for 10 minutes. Atmospheric pressure was reached in the device and the $CO_2$ impregnated tobacco was subjected to a stream of hot air at 500° F. for 8 seconds to expand the tobacco. A corrected cylinder volume of 72.1 cc/10 g was measured which corresponded to an expansion of 86%.

EXPERIMENT 3

A tobacco sample was chilled to a temperature of −40° F. and was subjected to a vacuum pressure of 11 mm Hg for a period of 10 minutes. $CO_2$ gas at −40° F. was admitted into the impregnator device and retained therein for 10 minutes. Atmospheric pressure was reached in the device and the $CO_2$ impregnated tobacco was subjected to a stream of hot air at a temperature of 520° F. for 9 seconds. A corrected cylinder volume of 62.3 cc/10 g was measured which correspond to an expansion of 64%.

EXPERIMENT 4

A tobacco sample was cooled to −40° F. and retained under a vacuum pressure of 25 mm Hg for a period of 2 minutes. $CO_2$ gas at a temperature of −30° F. was introduced into the impregnating device and retained therein for 10 minutes. The $CO_2$ impregnated tobacco was exposed to a stream of hot air at a temperature of 510° F. for 7 seconds. The tobacco sample exhibited a corrected cylinder volume of 57.8 cc/10 g which corresponded to an expansion of 52%.

EXPERIMENT 5

A sample of tobacco was cooled to a temperature of −93° F. and retained under a vacuum pressure of 2 mm Hg for a period of 10 minutes. $CO_2$ gas at a temperature of −30° F. was introduced into the impregnating device and retained therein for a period of 10 minutes. Atmospheric pressure condition were established in the device and subsequently, the $CO_2$ impregnated tobacco was heated in a stream of hot air at a temperature of 530° F. for a period of 13 seconds. The tobacco sample exhibited a corrected cylinder volume of 74.9 cc/10 g which corresponded to an expansion of 97%.

EXPERIMENT 6

A tobacco sample was cooled to a temperature of −4° F. and was subjected to a vacuum pressure of 2 mm Hg for a period of 10 minutes. $CO_2$ gas at a temperature of −40° F. was then introduced into the impregnating device and retained therein a period of 10 minutes. Atmospheric pressure conditions were established in the impregnating device. The $CO_2$ impregnated tobacco was subjected to a stream of hot air at a temperature of 540° F. for a period of 5 seconds. A corrected cylinder volume of 57.6 cc/10 g was obtained which corresponded to an expansion of 52%.

EXPERIMENT 7

A tobacco sample was chilled to a temperature of 30° F. and retained in an impregnating device under a vacuum of 2 mm Hg for a period of 10 minutes. $CO_2$ gas at a temperature of −30° F. was introduced into the device and retained therein for a period of 10 minutes. The $CO_2$ impregnated tobacco was then heated in a stream of hot air at a temperature of 510° F. for a period of 4 seconds. A corrected cylinder volume of 58.2 cc/10 g was obtained which corresponded to an expansion of 53%.

EXPERIMENT 8

A tobacco sample, in this case having an initial moisture level of 13.4%, was cooled to a temperature of −40° F. and retained under a vacuum of 3 mm Hg for a period of 10 minutes. $CO_2$ gas at a temperature of −20° F. was introduced into the impregnating device for a period of 10 minutes and was retained therein. The $CO_2$ impregnated tobacco was subjected to a stream of hot air at a temperature of 560° F. for a period of 12 seconds. A corrected cylinder volume of 67.3 cc/10 g was obtained which corresponded to an expansion of 77%.

EXPERIMENT 9

A tobacco sample having a moisture content of approximately 19% was cooled to a temperature of −40° F. and was subjected to a vacuum of 3 mm Hg for a period of ten minutes. $CO_2$ gas at a temperature of −18° F. was introduced into the impregnating device and was retained therein for a period of 10 minutes. The $CO_2$ impregnated tobacco was exposed to a stream of heated air at a temperature of 580° F. for a period of 10 seconds. A corrected cylinder volume of 73.5 cc/10 g was obtained which corresponded to an expansion of 93%.

It will be understood that the foregoing and other various changes in form and details may be made without departing from the spirit and scope of the present invention. Consequently, it is intended that the appended claims be interpreted as including all such changes and modifications.

We claim:

1. A method for expanding tobacco comprising the steps of:

cooling said tobacco to a temperature of approximately 30° F. or less;

subjecting said cooled tobacco to a vacuum pressure of 25 mm Hg or less in a vessel;

introducing $CO_2$ gas into said vessel to increase pressure therein to approximately, but not substantially greater than, atmospheric pressure such that said cooled tobacco is impregnated with said $CO_2$ gas; and subjecting said cooled, $CO_2$ impregnated tobacco to conditions such that said $CO_2$ impregnated in said tobacco is removed therefrom and said tobacco is expanded.

2. The method defined in claim 1 wherein the step of cooling said tobacco comprises reducing the temperature thereof while said tobacco is being subjected to said subatmospheric conditions.

3. The method defined in claim 1 wherein the step of cooling said tobacco comprises reducing the temperature thereof prior to subjecting said tobacco to said subatmospheric pressure conditions.

4. The method defined in claim 1 wherein the step of cooling said tobacco comprises cooling said tobacco to a temperature of about 0 to −110° F.

5. The method defined in claim 1 additionally comprising the step of cooling said $CO_2$ gas to a temperature below ambient temperature prior to introducing said gas into said vessel.

6. The method defined in claim 1 wherein the step of introducing $CO_2$ gas into said vessel to impregnate said cooled tobacco comprises retaining in said cooled tobacco an amount of $CO_2$ resulting in an increase of approximately 0.5–3.0% of the weight of said tobacco.

7. The method defined in claim 1 wherein the step of subjecting said cooled tobacco to subatmospheric pressure conditions comprises maintaining said vacuum for a period of time between approximately 1.0–30 minutes.

8. The method defined in claim 1 wherein the step of subjecting $CO_2$ impregnated tobacco to conditions to remove said $CO_2$ and expand said tobacco comprises contacting said impregnated tobacco with a stream of gases having a temperature between about 300–700° F. to thereby expand said tobacco.

9. The method defined in claim 1 wherein the step of subjecting $CO_2$ impregnated tobacco to conditions to separate said $CO_2$ and expand said tobacco comprises contacting said impregnated tobacco with steam having a temperature between about 300° F.–700° F. to thereby expand said tobacco.

10. The method defined in claim 1 wherein the moisture content of the tobacco upon introduction into said vessel is between approximately 10–30%.

* * * * *